United States Patent [19]

Perraud

[11] 4,300,642

[45] Nov. 17, 1981

[54] DEVICE FOR REAMING AND COLLECTING DUST, FOR A DRILLING APPARATUS

[75] Inventor: Raymond Perraud, Villeurbanne, France

[73] Assignee: Société d'Etude et de Construction de Machines pour toutes Industries S.E.C.O.M.A., Meyzieu, France

[21] Appl. No.: 129,257

[22] Filed: Mar. 11, 1980

[30] Foreign Application Priority Data

Mar. 14, 1979 [FR] France ..... 79 07077

[51] Int. Cl.[3] ..... E21C 7/00

[52] U.S. Cl. ..... 175/173; 175/209

[58] Field of Search ..... 175/135, 173, 209, 210, 175/211

[56] References Cited

U.S. PATENT DOCUMENTS

| | | | |
|---|---|---|---|
| 983,986 | 2/1911 | Dwyer | 175/209 X |
| 2,250,670 | 7/1941 | Joy | 175/173 |
| 2,270,334 | 1/1942 | Paget | 175/210 |
| 3,154,158 | 10/1964 | Lincoln | 175/135 |
| 3,703,212 | 11/1972 | Abrahams | 175/173 |
| 4,105,081 | 8/1978 | Perraud | 175/173 X |

FOREIGN PATENT DOCUMENTS

| | | | |
|---|---|---|---|
| 286398 | 2/1953 | Switzerland | 175/209 |

*Primary Examiner*—James A. Leppink
*Attorney, Agent, or Firm*—Karl F. Ross

[57] ABSTRACT

A combined device for reaming and collecting dust for use with a drilling apparatus makes it possible to produce a flared mouth for the drilled hole, in particular for subsequently facilitating the insertion of an anchor bolt. The device includes a reamer, through which the drilling bit of the apparatus passes axially, and which is integral with a sleeve through which the bit also axially passes and which is coupled to a hydraulic speed-reducing motor. The inner diameters of the sleeve and of the reamer are greater than the diameter of the bit, in order to provide an annular passage for the evacuation of dust. A container for collecting dust and provided with a guide for the drilling bit is disposed on the side of the driving sleeve opposite the reamer.

3 Claims, 3 Drawing Figures

DEVICE FOR REAMING AND COLLECTING DUST, FOR A DRILLING APPARATUS

FIELD OF THE INVENTION

The present invention relates to a device for reaming and collecting dust, and is for use with a drilling apparatus. This invention falls within the domain of apparatus, such as drilling slides or combined drilling and bolting apparatus, used in mines in particular for supporting the "roof" of a mine gallery by bolting, either with mechanical anchorage or by sealing with resin.

BACKGROUND OF THE INVENTION

After holes have been drilled in the "roof" of a subterranean gallery, a bolt is inserted in each hole. The bolt comprises a a bolt comprising a socket at its end, which, by to an expansion effect, is anchored in the bottom of this hole, after which tightening of this bolt brings about compression of the earth in the form of a column concentric with the shank of said bolt. The recent development of this method has seen expansion bolts replaced by rods sealed with resin, but three essential operations, namely: drilling of the hole, insertion of the bolt and tightening of the bolt, always have to be carried out.

French Pat. No. 1,359,297 discloses an apparatus which on its own and without having to be moved, is capable of carrying out these three operations in succession, by simple pivoting of the apparatus about the axis of a rod anchored in the "roof" of the level. This drilling and bolting apparatus essentially comprises a girder of H or other section, on which two carriages may slide, one for the drilling of the hole and the other for the introduction of the bolt into this hole and its tightening. The girder is able to pivot about the axis of the anchoring rod so that after pivoting, the axis of the bolt is aligned with the axis of the hole drilled immediately before the operation for introducing the bolt.

One difficulty encountered in the use of this apparatus is in making the axis of the bolt coincide exactly with the axis of the hole drilled previously, the diameter of the hole being only slightly greater than that of the bolt. This difficulty is all the greater, the greater the height of the gallery and its causes are varied. For example, the anchoring point may have undergone a slight shift or the design of the apparatus which comprises numerous parts able to move with respect to each other, as well as wear, causes inevitable play. Consequently, the introduction of the bolt must frequently be carried out, in practice, by a man standing on a mining car, thus defeating the initial purpose of the apparatus which is to eliminate any manual intervention.

To resolve this difficulty, and facilitate the introduction of the bolt (or resin cartridges), the aforesaid apparatus has been improved, according to the Certificate of Addition No. 2 337 250 of the above mentioned French Patent Specification, by providing that, at its upper end, the girder of H section supports a reaming device which is coaxial with the drilling bit, coming into operation at the end of the drilling operation, before pivoting of the girder, in order to widen the mouth of the hole drilled in the form of a cone. The reaming device comprises a reamer surrounding the drilling bit, the reamer being free to rotate and move longitudinally with respect to the bit, but being able to be set in rotation and to be pushed forward at the same time as the bit, when the drilling carriage virtually reaches the end of its travel.

This arrangement makes it possible to dispense with an additional motor for driving the reamer and it makes it possible to set the reaming device in operation automatically when the drilling carriage virtually reaches the end of its travel. However, it has two features requiring improvement.

Firstly, in order to drive the reamer when the bit arrives close to its end of travel position, it is necessary to provide coupling means between the rotary support for the bit and the reamer. These means, constructed in the manner of a clutch, either a friction clutch or other type of clutch, complicate the construction so that the advantage of eliminating an additional motor is illusive.

Secondly, in view of the fact that the reamer comes into operation solely when the hole has been virtually completely drilled by the bit, the collection of dust during drilling is unsatisfactory, even if a container for collecting the dust has already been provided for this purpose on the apparatus.

OBJECT OF THE INVENTION

The object of the present invention is to provide a combined device for reaming and collecting dust for use with a drilling apparatus such as that mentioned above.

SUMMARY OF THE INVENTION

According to the present invention there is provided a device for reaming and collecting dust for use with a drilling apparatus adapted to produce drilled hole with a flared mouth, the device comprising a reamer having an axial bore through which a drilling bit of the drilling apparatus is adapted to pass, a driving sleeve integral with the reamer and through which the bit is also adapted to pass axially and which is coupled to independent rotary driving means (i.e. driving means independent of that of the bit), the inner diameters of said sleeve and of the reamer bore being greater than the diameter of the drilling bit in order to provide an annular passage for the evacuation of dust around the bit, and a container for collecting dust located on the side of said sleeve opposite the reamer.

The reamer is thus driven by independent means, such as a hydraulic speed-reducing motor, which eliminates any coupling system for connection to the bit and makes it possible to operate the reamer at the beginning of the operation for drilling the main hole by the bit. The mouth of the hole drilled is thus given a conical or at least flared shape, which if necessary may facilitate the introduction of a bolt or resin cartridge and moreover, since the reamer remains pressed against the conical mouth after boring out the latter, a seal is obtained which facilitates the reliable evacuation of all the dust during drilling of the main hole by the bit, firstly through the annular passage provided between the driving sleeve and the bit, then through the collecting container which, in known manner, is connected to means for removing dust by suction.

In order to keep the bit and reamer in the correct relative coaxial position, a bit guide is advantageously fixed below the container for collecting dust.

BRIEF DESCRIPTION OF THE DRAWING

An embodiment of the present invention will now be described, by way of example, with reference to the accompanying diagrammatic drawings, in which.

SPECIFIC DESCRIPTION

Figure 1:
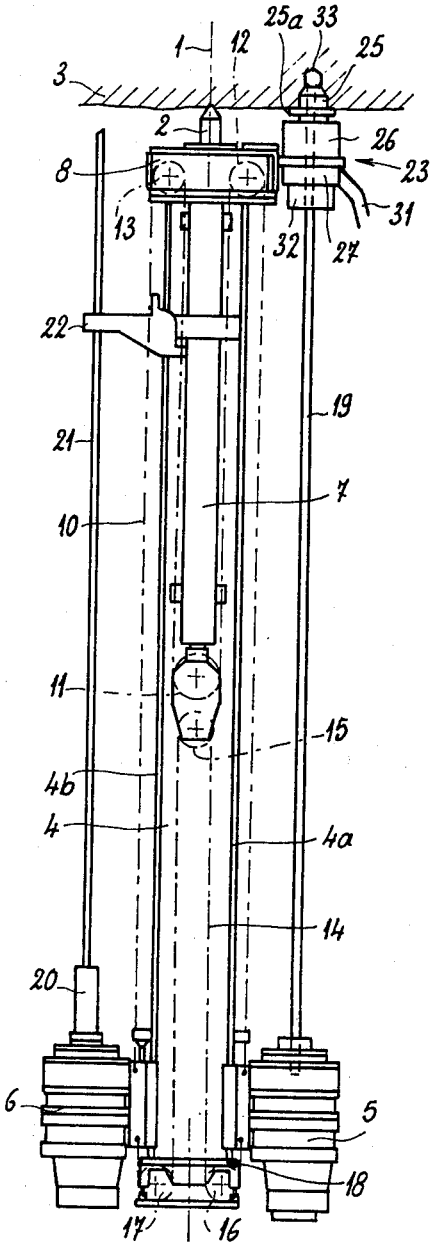
FIG. 1 is a side view of an apparatus for drilling and bolting and equipped with the device according to the invention, the apparatus being illustrated in the position at the beginning of drilling a hole.

The invention is described with reference to a drilling and bolting apparatus according to French Patent Specification No. 1 359 297 and which has a turret mounted to pivot and slide about an axis 1 at the end of a support arm (not shown), the axis 1 being vertical in the position of the apparatus illustrated in the drawing, but the axis 1 may assume any desired inclination. This axis 1 is formed by a rod whereof the upper end comprises a point 2 by means of which the apparatus is anchored in the rock 3. The turret of the apparatus is essentially constituted by a girder 4 of H section extending parallel to the axis 1, the sides 4*a* and 4*b* of the girder 4 serving as slideways respectively for a drilling carriage 5 and a bolting carriage 6 (which may also be termed drill and fastener).

The forward or return movement of the turret along the axis 1 is controlled by a jack (not shown) referred to as the forward feed jack, which is able to move the girder 4. The forward or return movement of each of the carriages 5 and 6 along the girder 4 is obtained by one and the same member constituted by a jack 7 suspended by the bottom of its cylinder from a part 8 supported by the top of the girder 4, the jack rod 9 extending downwards. A cable or chain 10 provided with pulley blocks passes over a pulley 11 supported by the head of the rod 9 of the jack 7. Each end of this cable or chain 10 is attached to one of the carriages 5 and 6 after having passed over the pulleys 12 and 13 respectively, supported by the part 8. When one of the carriages is immobilized and the rod 9 of the jack 7 is lowered, the other carriage thus moves upwards at a speed twice that of the rod 9. The return movement of the carriages is ensured by a similar but oppositely acting device constituted by a cable or chain 14 passing over another pulley 15 supported by the head of the rod 9 of the jack 7 and the ends of which are attached to one of the carriages 5 and 6, after having passed over pulleys 16 and 17 supported by a part 18 integral with the base of the girder 4. Thus, at the time of lifting of the rod 9, the carriage which was previously driven upwards along the girder 4 is returned to its initial position at the bottom of the latter.

The immobilization of one of the carriages is achieved by means of a bolt which locks one of the carriages in the lower position, when the girder 4 is located in one of the extreme angular positions of its pivotal movement about the axis 1. More precisely, when the girder 4 is in the drilling position, the bolting carriage 6 is locked in the lower position and when the girder 4 has pivoted and is located in the bolting position, it is the drilling carriage 5 which is locked in the lower position.

The rotary movements of the drilling bit 19 on the one hand and of the socket 20 which supports the bolt 21 on the other hand are brought about by two independent motors supported respectively by the carriages 5 and 6. These rotary movements could also be obtained by means of a traversing bar, from one or two motors at a fixed point.

At its upper part, the girder 4 also supports a guide 22 through which the bolt 21 passes.

All the parts described hitherto are already known and do not form the subject of the present invention.

Figure 3:
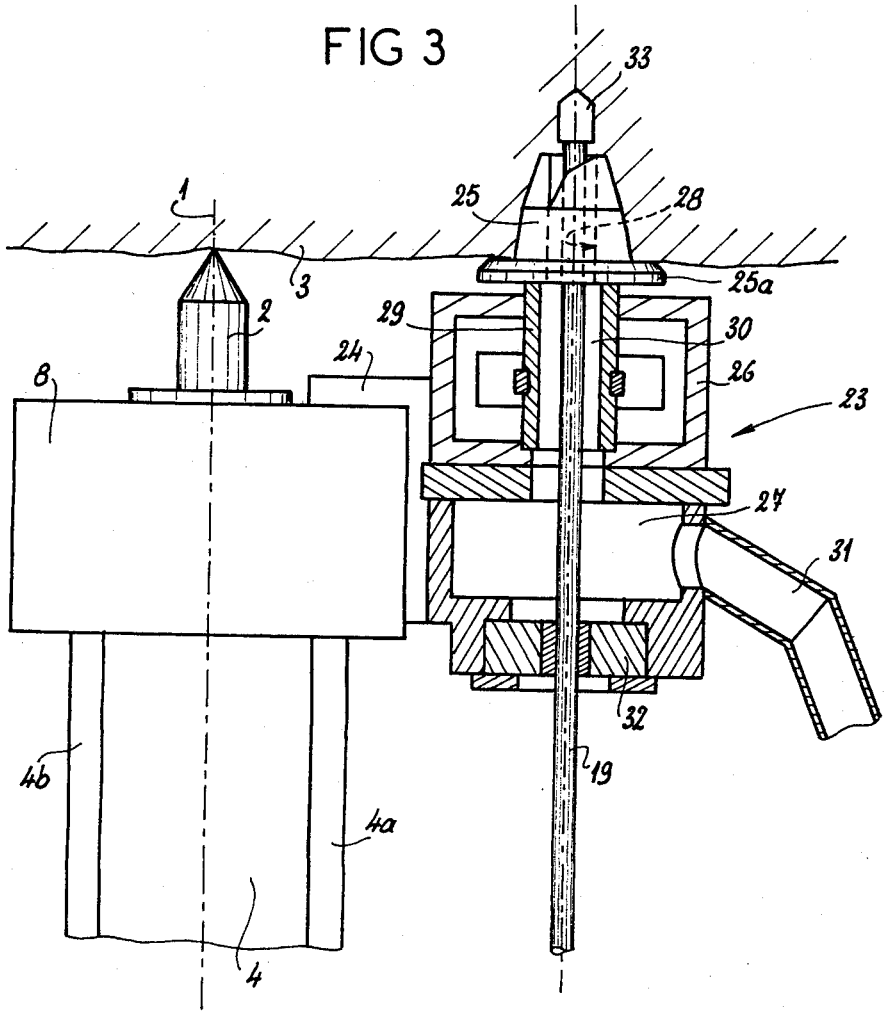
FIG. 3 is a partial view of the same apparatus, to an enlarged scale, showing the device for reaming and collecting dust in section.

The present invention is a combined reaming and dust collecting device, designated generally by the reference numeral 23, the structure of which is shown in FIG. 3. This device, which is coaxial with the drilling bit 19 and through which the latter passes, is fixed to the upper part 8 of the girder 4 by means of a support 24. The constituent parts of the device 23 are a reamer 25, a hydraulic speed reducing motor 26 and a container 27 for collecting dust, the hydraulic speed reducing motor 26 being disposed between the reamer 25 and the collecting container 27.

The reamer 25 comprising, for example, carbide plates designed to allow production of a hole of general conical shape in the rock 3, is provided along its axis and over its entire height with a central bore 28 through which the drilling bit 19 passes. This reamer 25 is extended beyond a flange 25*a* adjacent the speed reducing motor 26 by a driving sleeve 29. This sleeve 29, connected to rotate with the reamer 25, comprises, for example, external splines, enabling the latter to be set in rotation by a hollow output shaft of the speed reducing motor 26, the details of which are not shown.

According to one important feature, the diameter of the passage 28 of the reamer 25, as well as the internal diameter of the driving sleeve 29, are greater than the diameter of the bit 19, in order to provide a free space 30 of annular section through which dust from the front of the reamer 25 can be evacuated to the collecting container 27.

This collecting container 27, through which the bit 19 also passes along its axis, forms a cylindrical cavity from which a conduit 31 emerges, facilitating the removal by suction of the dust collected. Also fixed below the collecting container 27 is a bit guide 32, in the form of a ring, constucted to guide the rotary and longitudinal movements of the drilling bit 19 and so keep the latter coaxial with respect to the device and in particular with respect to the reamer 25.

Figure 2:
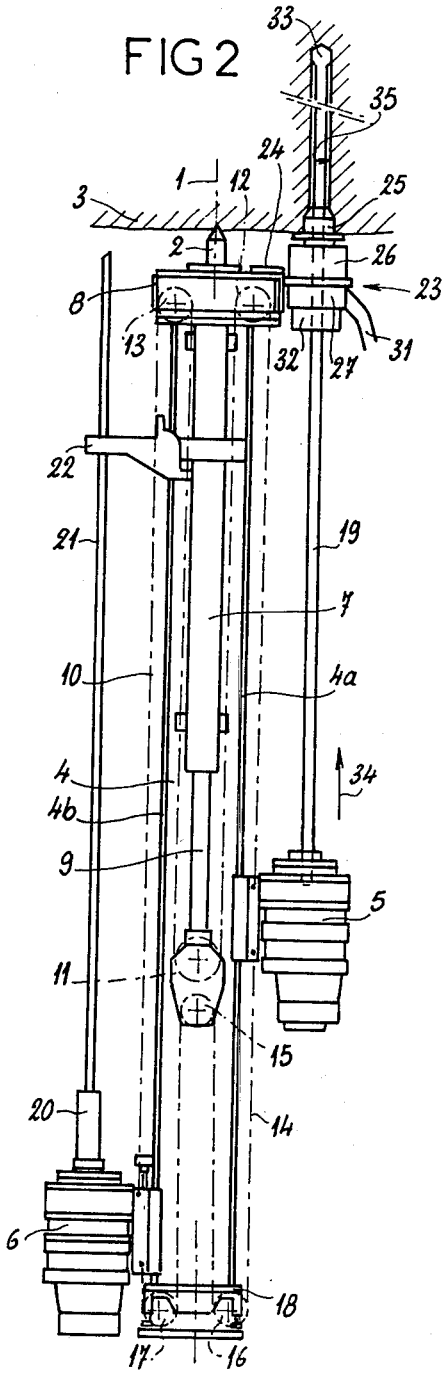
FIG. 2 is a view similar to FIG. 1, but showing the apparatus during drilling of a hole.

FIGS. 1 and 2 illustrate the operation of the apparatus equipped with the device 23, during the drilling operation, the bolting operation which follows the latter not being illustrated, since it is not changed by the present invention.

At the beginning of the cycle, the operator ensures that the point 2 is anchored in the rock 3 at a location which depends on the position to be occupied by the bolt 21 and which will remain fixed throughout the cycle. The two carriages 5 and 6 are brought into the lower position. By pivoting about the axis 1, the girder 4 is brought into its angular drilling position in which the axis of the bit 19 corresponds with that of the hole to be drilled. Then, by sliding along this axis 1, controlled by the forward feed jack, the girder 4 is pushed upwards and at the same time the bit 19 is set in rotation by the motor of the drilling carriage 5, as is the reamer 25 by means of the hydraulic speed reducing motor 26.

As the girder 4 moves forwards, the cutting edge 33 of the bit 19 and the reamer 25 penetrate the rock 3, until the flange 25*a* of the reamer is stopped. At this instant, the conical mouth of the hole to be drilled is produced (position of FIG. 1). In addition, from this instant, the frustoconical part of the reamer 25 ensures a seal with the rock 3, as illustrated in FIG. 3.

In the following stage, the speed reducing motor 26 for driving the reamer is stopped, whereas the drive motor for setting the bit 19 in rotation is kept operating. The jack 7 is actuated in order to cause the extension of its rod 9. In view of the angular position occupied by the girder 4, the bolting carriage 6 is locked in the lower position so that the drilling carriage 5 moves forward in the direction of arrow 34, thus forcing the cutting edge 33 of the bit 19 to penetrate the rock 3 (see FIG. 2).

During this stage, owing to the fact that the reamer 25 does not leave its position and forms a seal with the rock 3, all the rock dust produced by the cutting edge 33 is discharged to the collecting container 27, through the annular passage 30.

When the carriage 5 has reached the end of its forwards travel, the hole 35 to be produced is drilled over its entire length and has a conical mouth. The carriage 5 is then withdrawn, the girder 4 caused to descend and pivot about the axis 1, the point 2 being kept anchored in the rock 3 and constituting a fixed pivoting centre, so that at the end of the pivoting movement, the bolt 21 is located below the flared mouth of the hole 35.

The top of the girder 4 is thus once more pressed against the "roof" and bolting is carried out by means of the second carriage 6, the flared mouth facilitating the introduction of the bolt 21 if the latter is not presented exactly in alignment with the axis of the hole 35.

The invention is concerned in particular with the insertion of expansion bolts, whose introduction into the drilled holes is facilitated, as has been mentioned above, but it also has a considerable advantage for the technique of sealed rods, in which case it also facilitates the introduction of resin cartridges or the nozzle located at the end of a tube for the bulk injection of resin, or even any other sealing material such as concrete, according to the method used.

Furthermore, in view of the fact that the device according to the invention allows effective collection of dust, as has been described above, it may be used solely for this function, i.e. even in the case where the flared mouth cut by the reamer is not indispensable for the subsequent introduction of a bolt or other object to be placed in the drilled hole. Consequently, the field of application of the invention is in no way limited to apparatus of the type comprising a "drilling and bolting turret", but it extends to drilling apparatus in general.

Naturally and as is apparent from the preceding description, the invention is not limited to the single embodiment of this device for reaming and collecting dust which was described above, by way of example. On the contrary, it includes all variations whatever their application. In particular, the invention extends to equivalent means and thus the hydraulic speed reducing motor for the rotary drive of the reamer may be replaced by pneumatic or electrical driving means.

What is claimed is:

1. In a drilling apparatus adapted to produce a drilled hole in the roof of a mine gallery to receive a bolt, said apparatus comprising a support, a drill carriage mounted on said support, a bit rotatable on said carriage and extending upwardly therefrom, and means for vertically displacing said carriage to drill a hole in the roof of said gallery, the improvement which comprises in combination:

a reamer surrounding said bit and formed with a generally conical cutting portion adapted to form a flared mouth of said hole, said reamer and said bit defining an axially extending clearance all around said bit whereby drilling dust can pass downwardly through said galleries;

a driving sleeve integral with said reamer therebelow surrounding said bit with an axially extending clearance communicating with the clearance between said bit and said reamer;

drive means connected to said sleeve for rotating said reamer independently of said bit, said clearances forming an annular passage for said dust;

a container communicating with said passage and disposed below said sleeve for receiving said dust; and means connected to said container for evacuating collected dust therefrom.

2. The improvement defined in claim 1 wherein said drive means is a hydraulic speed-reducing motor disposed between said reamer and said container.

3. The improvement defined in claim 1 or claim 2, further comprising a guide for said bit fixed to the bottom of said container for maintaining said bit coaxial with said reamer.

* * * * *